US007652550B2

(12) United States Patent
Umeda et al.

(10) Patent No.: US 7,652,550 B2
(45) Date of Patent: Jan. 26, 2010

(54) HIGH-VOLTAGE GENERATING TRANSFORMER FOR DISCHARGE LAMP LIGHTING APPARATUS

(75) Inventors: Yusuke Umeda, Tokyo (JP); Keiko Konishi, Hyogo (JP); Takashi Ohsawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/223,528

(22) PCT Filed: Nov. 21, 2006

(86) PCT No.: PCT/JP2006/323221

§ 371 (c)(1),
(2), (4) Date: Aug. 1, 2008

(87) PCT Pub. No.: WO2007/105339

PCT Pub. Date: Sep. 20, 2007

(65) Prior Publication Data

US 2009/0009279 A1 Jan. 8, 2009

(30) Foreign Application Priority Data

Mar. 13, 2006 (JP) ..... 2006-068059

(51) Int. Cl.
*H01F 27/30* (2006.01)

(52) U.S. Cl. ..... 336/185; 315/57

(58) Field of Classification Search ..... 336/65, 336/192, 198, 208; 315/57
See application file for complete search history.

(56) References Cited

U.S. PATENT DOCUMENTS

| | | | | |
|---|---|---|---|---|
| 6,191,675 | B1 * | 2/2001 | Sudo et al. | 336/96 |
| 6,388,380 | B1 | 5/2002 | Minami et al. | |
| 6,624,596 | B1 * | 9/2003 | Ohsawa et al. | 315/276 |
| 2002/0195092 | A1 * | 12/2002 | Nagata et al. | 123/634 |

FOREIGN PATENT DOCUMENTS

| | | | |
|---|---|---|---|
| JP | 11-16749 | A | 1/1999 |
| JP | 2000-232029 | A | 8/2000 |
| JP | 2001-257087 | A | 9/2001 |
| JP | 2002-93635 | A | 3/2002 |
| JP | 2004-111451 | A | 4/2004 |
| JP | 2005-116880 | A | 4/2005 |
| JP | 200-322515 | A | 11/2005 |
| WO | WO-00/64221 | A1 | 10/2000 |
| WO | WO-02/15647 | A1 | 2/2002 |

* cited by examiner

*Primary Examiner*—Elvin G Enad
*Assistant Examiner*—Tszfung Chan
(74) *Attorney, Agent, or Firm*—Birch, Stewart, Kolasch & Birch, LLP

(57) ABSTRACT

A high-voltage generating transformer for a discharge lamp lighting apparatus according to the present invention includes a rodlike core; a secondary winding bobbin that is divided into a plurality of sections, and where the core is disposed in the central portion thereof; a secondary winding part wound on the secondary winding bobbin, divided between the plurality of sections of the bobbin; a primary winding bobbin disposed around the outer periphery of the secondary winding part; and a primary winding part wound on the primary winding bobbin; wherein the primary winding bobbin is changed in thickness every section or every plurality of sections of the second winding part such that the bobbin has a thickened thickness on the side where the potential difference between the primary winding part and the secondary winding part is high, and the bobbin has a thinned thickness on the side where the potential difference is low.

4 Claims, 3 Drawing Sheets

HIGH-VOLTAGE GENERATING TRANSFORMER FOR DISCHARGE LAMP LIGHTING APPARATUS

TECHNICAL FIELD

The present invention relates to a high-voltage generating transformer for a discharge lamp lighting apparatus, suitable mainly for a discharge lamp energized with a high current such as a high-intensity discharge lamp not using mercury.

BACKGROUND ART

Lighting of a high-intensity discharge lamp (HID bulb) used for a vehicle headlamp requires a high-voltage generating apparatus called "an igniter (IGN)" in general, and the igniter generating a high voltage uses a high-voltage generating transformer. For conventional high-voltage generating transformers for a discharge lamp lighting apparatus, the following conventional examples are listed up.

As a conventional example 1, the example is a high-voltage generating transformer fabricated by winding a primary winding part on a secondary winding part formed of rectangular electric wires edgewise wound around a bar core, and a feature of the example is that the secondary winding part formed of edgewise wound rectangular electric wire is assembled directly on a core of high-resistance Ni—Zn system ferrite, thus enabling the external shape of the winding part to be small and the axial length thereof to be shortened.

Further, the embodiment thereof shows that a variety of methods of winding a primary winding part can be employed, and also shows an example employing traverse-winding of rectangular electric wire by using insulated round copper wire and a primary winding bobbin, or an example using thin conducting foil insulated with film; however, in any of those ideas, the primary winding part is disposed biased toward the low voltage side of the secondary winding part (see Patent Document 1, e.g.).

In a conventional example 2, there is shown a high-voltage generating transformer having a structure similar to that of the above-described conventional example 1 (Patent Document 1), and the conventional example 2 treats the core thereof as a conductor in contrast to the conventional example 1 treating the core as an insulator. For this reason, the conventional example 2 requires having insulation between the core and the secondary winding part, and in order to cause the secondary winding bobbin to have an insulating property, the bobbin on the high voltage generating side of the secondary winding part is thickened. However, those conventional example 1 and conventional example 2 have the same arrangement in the fundamental portion of the primary winding part and the secondary winding part (see Patent Document 2, e.g.).

A conventional example 3 is a high-voltage generating transformer where a secondary winding part formed of round wire is wound on a bobbin divided into some sections and a primary winding part is wound around the outer periphery of the secondary winding part, and a feature of the conventional example 3 is that a structure is employed where a core having a hole at the center is used and a high-voltage output terminal penetrates through the core.

The conventional example 3 shows in its embodiment as with the conventional example 1 that various methods of winding the primary winding part can be used, and also shows an example where traverse-winding of rectangular electric wire is adopted by using insulated round wire and a primary winding bobbin; however, the example says that optimum disposition of the primary winding part is concentrating the winding part in the central section and even roughly wound winding part using a bobbin can give an excellent characteristic as long as the winding part is axially evenly disposed (see Patent Document 3, e.g.).

As a conventional example 4, the example is a high-voltage generating transformer intended for a high-intensity discharge lamp not using mercury as described later, and the transformer is fabricated by winding a primary winding part over a secondary winding part formed of rectangular electric wire wound on a bar core as with the conventional example 1. Lighting a high-intensity discharge lamp not using mercury requires a high current, and a feature of the conventional example 4 is that in order to reduce the secondary winding part in its axial length, having its thickness increased because of its cross-sectional area enlarged for flowing the high current, the secondary winding part is divided, the secondary winding part of the low voltage side is wound on the outside of the secondary winding part of the high voltage side, and further, the primary winding part is provided on the outside of the part of the low voltage side.

Moreover, the embodiment thereof also shows an idea where the wall of the bobbin functioning as a partition wall for obtaining a withstand voltage is formed in a stepwise shape or wedge shape in cross section according to the applied voltage (see Patent Document 4, e.g.).

Patent Document 1: JP-A-2002-093635
Patent Document 2: JP-A-2005-322515
Patent Document 3: JP-A-2001-257087
Patent Document 4: JP-A-2004-111451

Conventional high-voltage generating transformers used for discharge lamp lighting apparatuses are arranged as mentioned above, and are actualized and commercialized by using some methods.

Among those transformers, both high-voltage generating ones shown in the conventional example 1 (Patent Document 1) and the conventional example 3 (Patent Document 3) meet high-intensity discharge lamps (HID bulbs) using mercury (referred to as "conventional bulbs" hereinafter), and those technologies concerning the transformer are sufficiently completed for high-voltage generating transformers used for igniters.

However, thereafter, high-intensity discharge lamps not using mercury (referred to as "Hg-free bulbs" hereinlater) have begun to be put to practical use in consideration of mercury that is environmental material. Since an Hg-free bulb is energized with bulb current approximately two times greater than a conventional bulb is, the technology meeting conventional bulbs cannot sufficiently function by itself in designing a new igniter for an Hg-free bulb as follows. Therefore, the igniter therefor should be further enhanced in performance.

For example, although the rated powers of a conventional bulb and a Hg-free bulb for an on-vehicle headlamp are both 35 W; the rated current of an Hg-free bulb is 0.8 A; the rated current of a conventional bulb is 0.4 A; the rated voltage of an Hg-free bulb is 42 V; and the rated voltage of a conventional bulb is 85 V.

Therefore, in the winding part of a high-voltage generating transformer used for an igniter for an Hg-free bulb, it is necessary to reduce the electric resistance of the winding part by a factor of four in order to cope with the approximately doubled current and make the heat generation caused by the loss equivalent to the heat generation in the conventional bulb. For this reason, supposing that the diameter of the electric wire used for the winding part is simply doubled (four times in cross-sectional area), the winding part increases in volume, the portion housing the winding part provided on the bobbin also thereby increases, and the igniter increases in size and cannot be accommodated in the housing space of the headlamp, which can cause a size problem.

In order to cope with the size problem, even if the shapes of parts surrounding the igniter can be changed and the igniter increased in size can be thereby attached to the headlamp, all vehicles do not always have space for the expansion, and there is a possibility that the igniter cannot be used in another vehicle. This causes the igniter to lose its compatibility among varied vehicles, and results in causing the igniter to deteriorate its marketability as a component for vehicles.

Further, a winding part using thick electric wires puts a large distance between neighboring winding parts, and causes its magnetic flux making an interlinkage to leak, thus weakening its magnetic coupling. This deteriorates its electric performance, and also causes a characteristic problem.

As described above, a high-voltage generating transformer intended for an Hg-free bulb requires a heavy-current specification as compared with that of a transformer intended for a conventional bulb. Cases of trying to cause each of the above-stated conventional examples to accommodate the high-current specifications will be explained hereinafter.

In the conventional example 1 (Patent Document 1), in order for the example to meet the above-described high current, the rectangular electric wire constituting the secondary winding part needs to be enlarged in width or thickness; however, in the structure using the secondary winding part where rectangular electric wire is edgewise wound as described above, there is a limitation in the ratio of the width to the thickness of rectangular electric wire capable of being edgewise wound. It is impossible to enlarge the wire only in width while maintaining the wire in the thickness required for a conventional bulb and at the same time keeping the transformer in the total length required therefor. It is required to enlarge the wire in width and simultaneously increase the wire also in thickness. Accordingly, if a high-voltage generating transformer is built depending on the type of the conventional example 1 by using rectangular electric wire having an increased cross-sectional area because of being increased in thickness and width for energizing the transformer with a high current, the secondary winding part increased in thickness and width increases the high-voltage generating transformer in the diametrical direction and the axial direction (in the longitudinal direction of the core), and the transformer increases the igniter in size. There is a problem that an igniter having the same size as that of an igniter intended for a conventional bulb cannot be fabricated.

In the case of the conventional example 2 (Patent Document 2), in order to pass a high current the rectangular electric wire constituting the secondary winding part is increased in thickness, which increases the distance from the primary winding part to the secondary winding part (especially the secondary winding part located on the side opposite from the primary winding part) (the core is also elongated). For this reason, the magnetic flux generated by the primary winding part becomes easy to leak from halfway the elongated secondary winding part. If the magnetic flux generated by the primary winding part leaks from partway the secondary winding part, the magnetic flux generated by the primary winding part does not reach the portion of the secondary winding part located remotely from the primary winding part. The portion of the secondary winding part that the magnetic flux does not reach does not function as the part of a transformer. Therefore, there is a problem that the igniter pulse voltage generated on the side of the secondary winding part becomes low, and thereby, the high-voltage generating transformer cannot deliver sufficient performance.

In the conventional example 3 (Patent Document 3), also in the structure such as that of this conventional example, where the primary winding part is wound around the outer periphery of the secondary winding part formed of round wire, divided into some sections, the wire shape of the secondary winding part is compelled to be enlarged in order to meet a large current applied to an Hg-free bulb.

Accordingly, also in the high-voltage generating transformer based on the conventional example 3, when electric wire having a heavy shape in cross section for passing a large current is used, there occurs a problem that the igniter increases in size as with the case of the conventional example 1, and moreover, there occurs a problem of performance described later.

To say more exactly, the secondary winding part constituting the high-voltage generating transformer expands in the direction of coil diameter (in the diametrical direction), and is axially elongated, which increases the distance from the primary winding part to the secondary winding part in the diametrical direction (to the layer of the secondary winding part located in the central portion) and in the axial distance. The increase of the distance between the primary winding part and the secondary winding part causes the magnetic flux generated by the primary winding part to easily leak from halfway the radially expanded winding part or from halfway the axially elongated winding part. When the magnetic flux generated by the primary winding part leaks from halfway, there occurs a problem that sufficient output cannot be obtained as with the case of the conventional example 2.

In the conventional example 4 (Patent Document 4), the example is intended for meeting an Hg-free bulb as previously stated, and is disclosed with the intention of further enhancing the performance of an igniter by solving the above-mentioned problem occurring in supporting an Hg-free bulb, to be more precise, the problem of size of the igniter accommodated in a limited space for vehicle use, or the problem of electric performance (characteristic) deterioration of a high-voltage generating transformer.

However, when the secondary winding part is divided between the low voltage side and the high voltage side and the divided portions of the winding part are placed in superposed relation, a bobbin for isolation for obtaining the withstand voltage between the high voltage section and the low voltage section is used, and further, the primary winding part is disposed biased toward one side of the secondary winding part. For this reason, it is inevitable that the distance from the primary winding part to the secondary winding part will be increased, the structural problem that the magnetic flux generated by the primary winding part easily leaks from halfway the secondary winding part is not so improved, and there is a possibility (problem) that the obtained transformer cannot deliver sufficient performance as a high-voltage generating transformer.

The above explanations are given to the cases of trying to cause the conventional examples 1-4 to meet high-current requirements.

About the leak of the generated magnetic flux described in the above-mentioned problem occurring in meeting an Hg-free bulb, in order to prevent the magnetic flux from leaking through the clearances between lines of the primary winding part, and also prevent the magnetic flux from leaking through the clearance between the secondary winding part and the primary winding part by keeping both the winding parts in close contact with one another, it can be said that the structure of a high-voltage generating transformer having a three-layer structure where the secondary winding part is divided between two bobbins in the direction of coil diameter (in the diametrical direction) and the primary winding part is inserted between the secondary winding part divided into two portions is most suitable. Further, the three-layer structure reduces the axial length thereof.

However, in the high-voltage generating transformer having the above-mentioned three-layer structure where the axial length can be reduced, there occur problems that the radius of the convolution of the secondary winding part increases because the diameter of the winding part expands and the length of the secondary winding part required for the convolution increases to thereby increase the resistance of the secondary winding part, thus resulting in no enhancement of characteristic, and further, increasing the igniter in size.

As mentioned hereinabove, if the structures based on the conventional examples are applied to fabricating the high-voltage generating transformer used for the Hg-free bulb newly commercialized, the problems of increase in the size of an igniter and deterioration in the characteristics of the igniter cannot be solved.

The present invention has been made to solve the above-mentioned problems, and an object of the present invention is to provide a high-voltage generating transformer for a discharge lamp lighting apparatus, which does not excessively increase an igniter in size, reduces the leak of the magnetic flux generated from a primary winding part to cause the magnetic flux to make an interlinkage with a secondary winding part, and has characteristics meeting the lighting of an Hg-free bulb.

DISCLOSURE OF THE INVENTION

The high-voltage generating transformer for a discharge lamp lighting apparatus according to the present invention includes a rodlike core; a secondary winding bobbin that is divided into a plurality of sections, and where the core is disposed in the central portion thereof; a secondary winding part wound on the secondary winding bobbin, divided between the plurality of sections of the bobbin; a primary winding bobbin disposed around the outer periphery of the secondary winding part; and a primary winding part wound on the primary winding bobbin; wherein the primary winding bobbin is changed in thickness every section or every plurality of sections of the second winding part such that the bobbin has a thickened thickness on the side where the potential difference between the primary winding part and the secondary winding part is high, and the bobbin has a thinned thickness on the side where the potential difference is low.

As described above, according to the present invention, the insulation between the primary winding part and the secondary winding part is ensured, while the leakage of the magnetic flux generated by the primary winding part is reduced, and the generated magnetic flux is caused to make an interlinkage with the secondary winding part, thus enabling the high-voltage generating transformer for a discharge lamp lighting apparatus to improve in characteristics, and enabling the transformer to meet the lighting of an Hg-free bulb because it is arranged that the primary winding bobbin be changed in thickness every section or every plurality of sections of the secondary winding part such that the primary winding bobbin has a thickened thickness on the side where the potential difference is high between the secondary winding part wound on the secondary winding bobbin where the core is disposed in its central portion, divided between the plurality of sections of the bobbin, and the primary winding part wound on the primary winding bobbin disposed around the outer peripheral side of the secondary winding part, and the primary winding bobbin has a thinned thickness on the side where the potential difference is low.

BEST MODE FOR CARRYING OUT THE INVENTION

Embodiments of the present invention will now be described with reference to the accompanying drawings in order to explain the present invention in more detail.

First Embodiment

Figure 1:
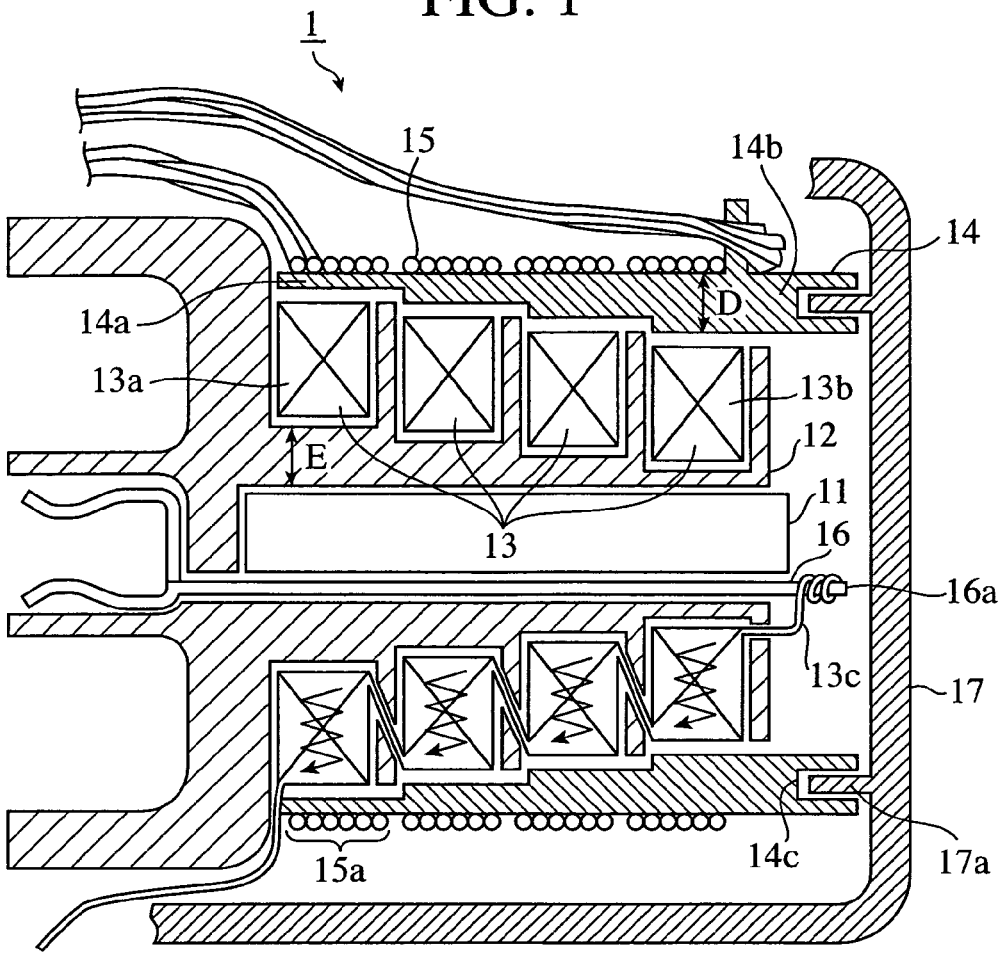
FIG. 1 is a structural explanatory view showing a structure of a high-voltage generating transformer for a discharge lamp lighting apparatus in accordance with the first embodiment of the present invention.

FIG. 1 is a structural explanatory view showing a structure of a high-voltage generating transformer for a discharge lamp lighting apparatus in accordance with the first embodiment of the present invention, and shows the cross section of the high-voltage generating transformer for a discharge lamp lighting apparatus.

Referring to FIG. 1, a high-voltage generating transformer for a discharge lamp lighting apparatus 1 (referred to as a "high-voltage generating transformer" hereinafter) is arranged such that a secondary winding bobbin 12 divided into a plurality of sections and having a core 11 of rodlike magnetic material disposed in its center has wound thereon a secondary winding part 13 divided between the sections thereof; a primary winding bobbin 14 disposed on the peripheral side of the secondary winding part 13 has a primary winding part 15 wound thereon; and the high voltage generated in the secondary winding part 13 is output through an output terminal 16; and the transformer itself is housed in a housing case 17. It should be appreciated that the secondary winding bobbin 12 as shown in FIG. 1 is one example divided into four sections.

Before explaining the structure of the high-voltage generating transformer 1 shown in FIG. 1 in details, the functions of the transformer having the structure shown in FIG. 1 will be described by reference to FIG. 2.

Figure 2:
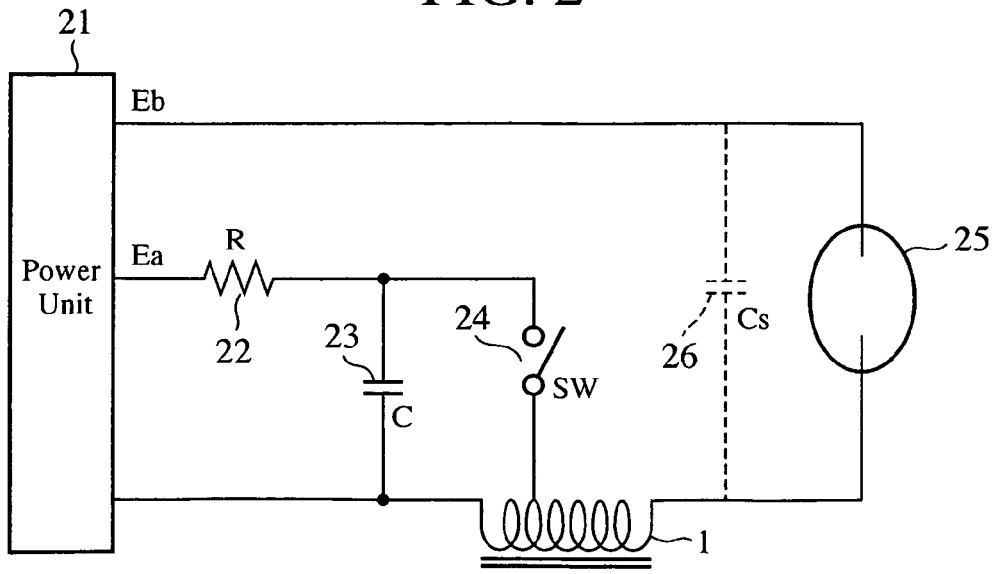
FIG. 2 is a circuit diagram of a discharge lamp lighting apparatus for explaining the functions of the high-voltage generating transformer for a discharge lamp lighting apparatus in accordance with the first embodiment of the invention.

FIG. 2 is a circuit diagram of a discharge lamp lighting apparatus for explaining the functions of the high-voltage generating transformer 1.

In FIG. 2, the discharge lamp lighting apparatus is composed of the high-voltage generating transformer 1, a power unit 21, a resistor (R) 22, a capacitor (C) 23, a gap switch (SW) 24, and a high-intensity discharge lamp 25 (HID bulb).

In the above-mentioned arrangement, the power unit 21 includes a boosting direct current (DC)/direct current (DC) converter and so on, and generates a predetermined voltage Ea and voltage Eb based on a DC power supply such as a battery. Generated voltage Ea is applied to the capacitor 23 through the resistance 22 to charge the capacitor 23.

When the voltage across the capacitor 23 reaches a predetermined high voltage by the charge, the gap switch 24 to which the voltage across the capacitor 23 is applied is subjected to a dielectric breakdown to be turned on, and thereby, the discharge voltage of the capacitor 23 is applied to the primary winding part of the high-voltage generating transformer 1. The applied voltage generates a high-voltage pulse in the secondary winding part of the high-voltage generating transformer 1, and the high-voltage pulse is applied to the HID bulb 25. In the HID bulb 25, the application of the high-voltage pulse causes a breakdown between its electrodes to start discharge to be activated. The HID bulb 25 after the discharge is activated goes to a state of normal lighting by the application of the voltage Eb from the power unit 21.

As described above, the high-voltage generating transformer 1 has the functions of causing the secondary winding part to generate the high-voltage pulse based on the voltage applied to the primary winding part, and activating the HID bulb 25.

It should be noted that in an actual high-voltage generating transformer 1, there exists capacitive component (Cs) 26 consisting of stray capacitance and parasitic capacitance, as a load, and there exists a second current charging the capacitive component (Cs) 26 when the high-voltage pulse is generated. And an effect canceling the magnetic flux generated by the primary winding part occurs by the second current flowing through the secondary winding part, which does not allow the magnetic flux to reach the entire secondary winding part, and causes a partial leak.

Therefore, a highly-efficient characteristic of minimizing the leakage of the generated magnetic flux is requested of the high-voltage generating transformer 1, and there are demanded measures directed toward the prevention of size increase of an igniter.

A model of magnetic flux of the high-voltage generating transformer 1 will next be explained with reference to FIG. 3.

Figure 3:
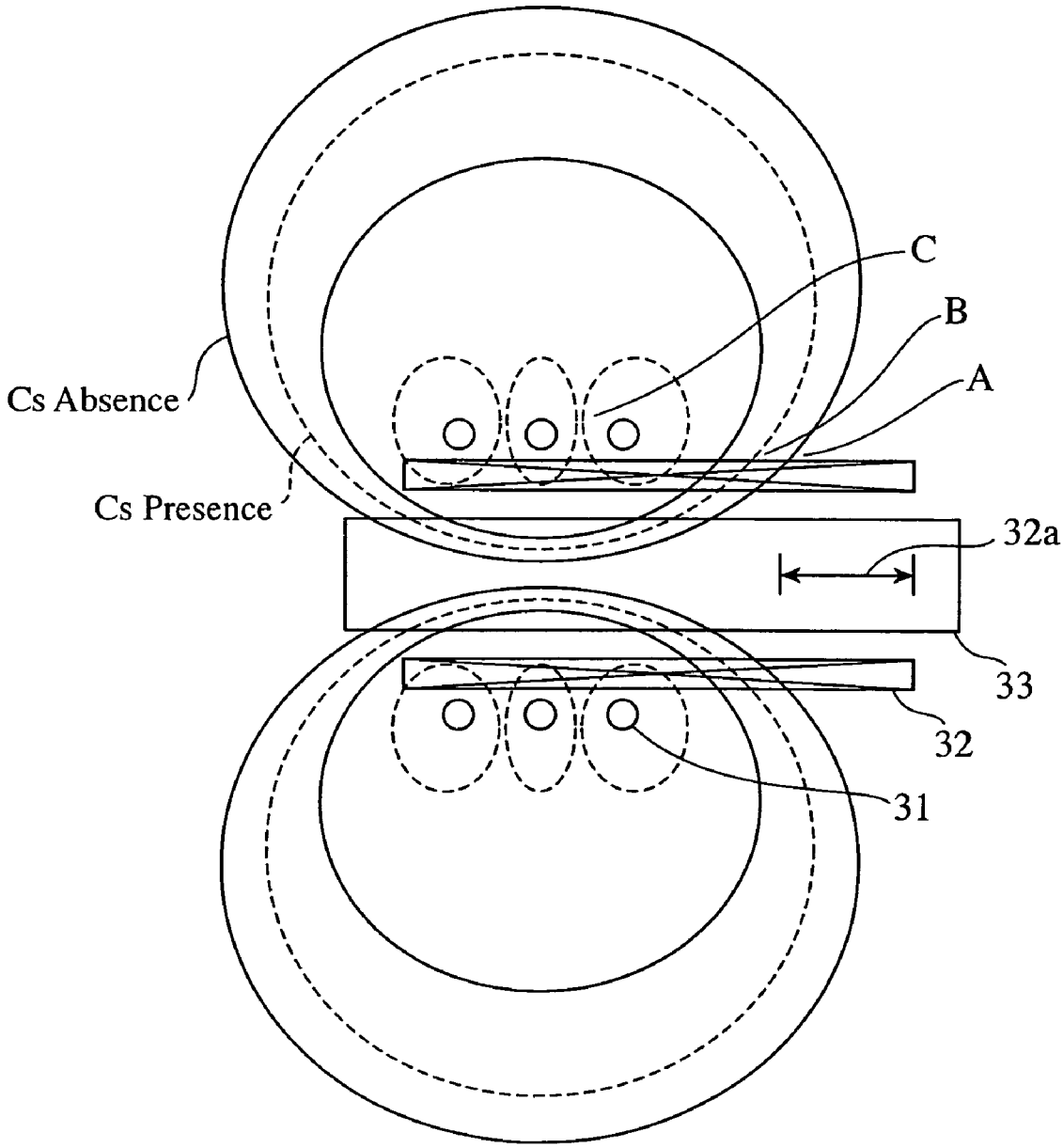
FIG. 3 is an explanatory view of a model of magnetic flux of the high-voltage generating transformer for a discharge lamp lighting apparatus in accordance with the first embodiment of the invention.

FIG. 3 is an explanatory diagram of a model of magnetic flux of the high-voltage generating transformer 1. Note that the structural forms as shown in FIG. 3 do not always correspond to those as shown in FIG. 1 for convenience in illustrating the model of magnetic flux.

Referring to FIG. 3, the high-voltage generating transformer used in a discharge lamp lighting apparatus requiring a high-voltage pulse often uses a transformer such as that shown in FIG. 3 in a size-reduction oriented or prioritized manner, fabricated by winding a primary winding part 31 and a secondary winding part 32 around a core 33 of a rodlike magnetic material. The transformer using the rodlike core 33 has an opened magnetic circuit, and allows the magnetic flux generated from the primary winding part 31 to easily leak before reaching the end portion of the secondary winding part as shown by portion A of FIG. 3, which causes a portion of the magnetic flux generated by the current flowing through the primary winding part not to make an interlinkage with a partial region 32*a* of the secondary winding part as shown in FIG. 3, e.g. Such a portion of the secondary winding part that the magnetic flux does not reach does not function as the part of a transformer. In such a case, increasing the diameter of the core 33 makes it possible to reduce the portion where the magnetic flux does not make an interlinkage with the secondary winding part; however, the method is not beneficial to the fabrication of small high-voltage generating transformers.

Moreover, as explained in FIG. 2, in an actual high-voltage generating transformer, there exists the capacitive component (Cs) 26 as a load, and an effect canceling the magnetic flux generated by the primary winding part occurs due to the capacitive component (Cs) 26, by the current flowing through the secondary winding part. Therefore, if the capacitive component (Cs) 26 does not exist, the magnetic flux generated by the primary winding part is shown by the magnetic flux shown by the solid line of FIG. 3; however, the magnetic flux becomes shown by the flux shown by the dashed line of FIG. 3 because of the above canceling effect produced by the capacitive component (Cs), thus causing the magnetic flux generated by the primary winding part to further leak as shown by portion B smaller than portion A shown in FIG. 3, and making it further difficult for the magnetic flux generated by the primary winding part to make an interlinkage with the secondary winding part. The portion of the magnetic flux that cannot make an interlinkage with the secondary winding part accumulates between the primary winding part and the secondary winding part, and sometimes passes between lines of the primary winding part as shown in portion C in FIG. 3.

Thus focusing attention on the above magnetic flux generated by the primary winding part, in order to improve the characteristics of the high-voltage generating transformer 1, it is necessary to lead the magnetic flux generated from the primary winding part by minimizing the leak thereof. Therefore, the following measures need to be taken to prevent the leak thereof.

(a) The primary winding part is disposed in close proximity to the secondary winding part over the entire region of the secondary winding part; the portion of the secondary winding part remote from the primary winding part is eliminated; and the clearance therebetween is reduced; thus preventing the magnetic flux from leaking.

(b) The primary winding part is wound by winding a plurality of material wires in parallel, and the gap between the wires is narrowed to reduce the magnetic flux leak therebetween, to thereby lead the magnetic flux generated by the primary winding part to the secondary winding part.

The structure of the high-voltage generating transformer 1 will next be described by referring to FIG. 1 in details.

First, the structure of the primary winding bobbin 14 will be explained.

Based on the measures (a), the high-voltage generating transformer 1 is arranged such that the primary winding part 15 thereof is disposed outside all sections of the secondary winding part 13, and the wall of the primary winding bobbin 14 functioning as an isolation wall between the primary winding part 15 and the secondary winding part 13 is reduced in thickness. However, although the wall thereof on the low voltage side (14*a*) where the potential difference between the primary winding part and the secondary winding part is small can be thinned, the wall of the primary winding bobbin 14 on the side (high voltage side 14*b*), opposed to the portion of the secondary winding part 13 where high voltage is generated, requiring a high withstand voltage is compelled to be thickened.

For this reason, the primary winding bobbin 14 is arranged to have a thickness that is made as thin as possible on the low voltage side (14*a*) where the potential difference between the primary winding part 15 and the secondary winding part 13 is low, and is arranged to have a thickness that is thickened in order to obtain a high withstand voltage on the high voltage side (14*b*) where the potential difference between the primary winding part 15 and the secondary winding part 13 is high. The primary winding part 15 is wound around the outer periphery of the primary winding bobbin 14 having such a structure such that the winding thereof covers the entire region of the secondary winding part.

A specific example meeting the above-described requirements is shown by the shape thereof shown in FIG. 1. As shown in FIG. 1, the primary winding bobbin 14 is arranged to have a thickness stepwise changed each section of the secondary winding part 13 where the voltages vary from one section to another. FIG. 1 shows the structure where the stepwise shape is provided on the inner side (the inner periphery) of the primary winding bobbin 14, and an example of a bobbin having such a structure is shown in FIG. 4.

Figure 4:
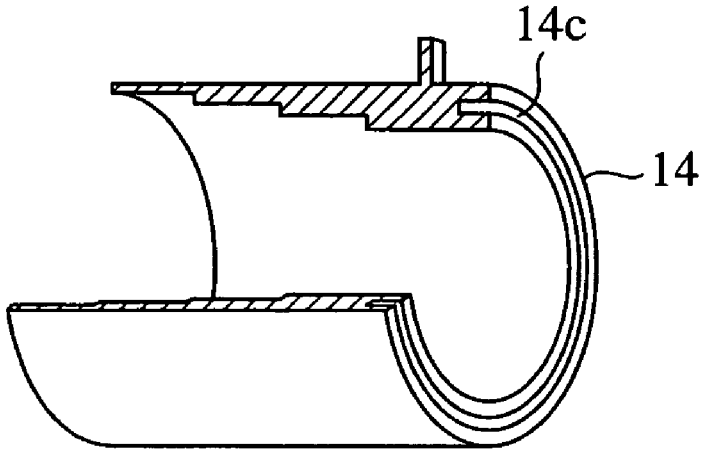
FIG. 4 is a structural explanatory view of a primary winding bobbin used for the high-voltage generating transformer for a discharge lamp lighting apparatus in accordance with the first embodiment of the invention.

FIG. 4 is a structural explanatory view of the primary winding bobbin 14, and is an external oblique view, partially broken away, showing the bobbin.

As shown in FIG. 4, the primary winding bobbin 14 has a stepwise shape on the inner side (the inner periphery) and a constant (level) shape on the outer side (the outer periphery). Thereby, winding the primary winding part 15 around the outer periphery thereof becomes easy, and the primary winding part is conveniently manufactured.

Fabricating the high-voltage generating transformer 1 in the above-described manner can further improve the transformer in characteristics.

Moreover, regarding the stepwise shape of the primary winding bobbin 14, the shape thereof shown in FIG. 1 is stepwise changed every section of the secondary winding part 13; however, the shape thereof may be stepwise changed every plurality of sections thereof.

Further, the transformer may have a structure where the bobbin has a stepwise shape on the outer side (the outer periphery) of the primary winding bobbin 14 and has a constant (level) shape on the inner side (the inner periphery) instead of having the structure where the bobbin has the stepwise shape on the inner side (the inner periphery) as shown in FIG. 1. In that case, winding the primary winding part 15 becomes difficult; however, the effect can be obtained of improving the high-voltage generating transformer 1 in characteristics, equivalent to that of the structure where the bobbin has the stepwise shape on the inner side (the inner periphery).

It should be understood that although an idea where a bobbin having a changed thickness is used is disclosed in Patent Document 4 (FIG. 22) described above, the idea is used with the objective of ensuring withstand voltages in a high voltage portion and a low voltage portion in a secondary winding part folded into two parts, and the idea is different from that concerning the structure shown in FIG. 1 where the bobbin having a thickness changed for a reason of the potential difference between the primary winding part 15 and the secondary winding part 13 is used.

The structure of the secondary winding bobbin 12 will next be explained.

As mentioned above, the inner side (the inner periphery) of the primary winding bobbin 14 is formed in a stepwise shape, the primary winding part 15 is disposed outside all sections of the secondary winding part 13, and further, the clearance between the primary winding part 15 and the secondary winding part 13 is narrowed, which enables the high-voltage generating transformer 1 to further improve in characteristics.

In order for the clearance between the primary winding part 15 and the secondary winding part 13 to be narrowed, it is necessary to raise the secondary winding part 13 in the direction toward the internal diameter of the primary winding bobbin 14 along the internal diameter thereof. The raising thereof is useful as means for changing the dielectric strength by the potential difference between the primary winding part 15 and the secondary winding part 13 by means of changing the positions of both the parts.

Therefore, when the primary winding bobbin 14 is arranged to have a uniform thickness instead of forming the inner side (the inner periphery) of the primary winding bobbin 14 in a stepwise shape, a packing material having an insulating property equivalent to that of the primary winding bobbin 14 is packed between the primary winding bobbin 14 having the uniform thickness and the secondary winding part 13, and the inner side thereof is formed in a stepwise shape containing the shape of the packing material, an effect equivalent to that of the primary winding bobbin 14 of which the inner side (the inner periphery) is formed in a stepwise shape, as shown in FIG. 1 and FIG. 4 can be obtained.

Further, the method of raising the secondary winding part 13 includes the method of changing the number of turns of the secondary winding part 13 every section and the method of forming the core 11 located in the central portion in a stepwise shape or thickening the core in a wedgelike shape, according to the sections; however, when the output terminal 16 of high voltage is disposed along the core 11 disposed in the central portion as shown in FIG. 1, it is necessary to ensure a withstand voltage between the output terminal 16 and the secondary winding part portion 13*a* in the low voltage section, which requires that the secondary winding bobbin 12 in the portion where the output terminal 16 and the secondary winding part portion 13*a* are opposed to each other have a thickness capable of ensuring the withstand voltage. The thickness (E) of the opposing portion in the secondary winding bobbin 12, which is required for ensuring the withstand voltage is approximately equal to the thickness (D) of the primary winding bobbin 14 required for ensuring the withstand voltage between the portion of the primary winding part 15 located along the outer periphery of the high voltage section of the secondary winding part 13 and the secondary winding part portion 13*b* in the high voltage section. Therefore, the secondary winding bobbin 12 reduces in wall thickness on one side, while increases in wall thickness on the other side every section of the secondary winding part 13. More specifically, the outer periphery of the secondary winding bobbin 12 is arranged to be formed in a stepwise shape from section to another as with the inner side (the inner periphery) of the primary winding bobbin 14. As a result, the length of the clearance between the inner periphery of the primary winding bobbin 14 and the outer periphery of the secondary winding part 13 becomes the same in any of sections of the secondary winding part 13, which enables the winding part to be constructed where the leakage of the magnetic flux is small while ensuring the withstand voltage in each section, and enables the improvement of the characteristics of the high-voltage generating transformer.

The above secondary winding bobbin 12 shown in FIG. 1 is formed in a stepwise shape each section of the secondary winding part 13; however, the bobbin may be formed in a stepwise shape every plurality of sections thereof.

It should be noted that the structure disclosed in the present invention is the same as that disclosed in the conventional example 2 (Patent Document 2) in that the thickness of the secondary winding bobbin 12 is changed; however, the structure shown in FIG. 1 is that having the primary winding part 15 covering the secondary winding part 13, and the idea of the present invention is absolutely different from that of the conventional example 2 in terms of disposition of the primary winding part and the secondary winding part formed as "a non-superimposed layer" in the conventional example 2.

The primary winding bobbin 15 will next be explained.

Based on the measures (b), the primary winding part 15 is wound by winding a plurality of wires in parallel. The primary winding part 15 shown in FIG. 1 is an example where six wire materials (six small circle marks 15*a*) are wound in parallel.

This can reduce the magnetic flux passing through between lines shown by portion C in FIG. 3, enables the magnetic flux generated by the primary winding part 15 to be more led to the secondary winding part 13, and enables the high-voltage generating transformer 1 to further improve in characteristics.

Here, the idea that rectangular electric wire having a large width or conductive thin foil is used for the primary winding part is shown in the conventional example 1 (Patent Document 1); however, current does not uniformly flow through a conductor having a large width. In taking as an example the conductive thin foil wound as the primary winding part disclosed in the conventional example 1, if the conductive thin foil is deployed, the foil functions as with a rectangular electrode. If current is applied between two points on the rectangular electrode, the current is concentrated on a route in the shortest distance within the rectangular face. The space except the route where the current flows does not generate magnetic flux, resulting in leaking magnetic flux.

Therefore, in order to fabricate a preferable high-voltage generating transformer 1, dividing the winding part into a plurality of parallel electric wires is effective as the means for uniformly generating the magnetic flux from the primary winding part 15 axially of the winding part and reducing the leakage. This permits the high-voltage generating transformer 1 to further improve in characteristics.

Further, in winding the primary winding part 15 by winding a plurality of wire materials in parallel, the cross-sectional area per one wire of the wire material constituting the primary winding part does not need to be increased. If the total cross-sectional area of the plurality of wire materials wound in parallel is equivalent to the cross-sectional area of a single wire capable of passing a primary current to be passed, the wire materials can pass current equivalent to the current the single wire can pass. This allows each of the plurality of wire materials wound in parallel to be reduced in diameter.

For this reason, using fine wire materials for the primary winding part 15 enables the high-voltage generating transformer 1 to furthermore improve in characteristics, and further, enables the outermost diameter of the transformer to be reduced, thus enabling the size-reduction of the high-voltage generating transformer 1.

Prevention of discharge between the high voltage generating portion of the secondary winding part 13 and the primary winding part 15 will next be explained.

There is a high potential difference between the lead-out portion 13*c* or the tip 16*a* of the output terminal 16 of the secondary winding part 13 where high voltage is generated and the primary winding part 15 of low voltage wound on the primary winding bobbin 14 opposed to those portions. There is a possibility that discharge is generated via the space therebetween to destroy the high-voltage generating transformer 1. In order to avoid the damage caused by the discharge, elongating the creeping distance of the discharge route is effective.

Thus, a structure is employed where a recess 14*c* is provided in the terminal portion of the primary winding bobbin 14 opposed to the high voltage generating portion of the secondary winding part 13, meanwhile, a foldlike protrusion 17*a* of an insulating wall is provided in the case 17 housing the high-voltage generating transformer 1, and further, the foldlike protrusion 17*a* is inserted and assembled in the recess 14*c* such that the inner face of the recess 14*c* and the outer face of the foldlike protrusion 17*a* are opposed to each other. The insulating wall of the foldlike protrusion 17*a* elongates the creeping distance between the primary winding part 15 of low voltage and the lead-out portion 13*c* or the tip 16*a* of the output terminal 16 of the secondary winding part 13 outputting high voltage, which enables the withstand voltage between the two portions to be ensured, and enables the destruction caused by discharge to be avoided even in the narrow space of the small high-voltage generating transformer 1.

The first embodiment thus arranged as mentioned above permits the withstand voltage to be ensured on the high voltage side 14*b* where the potential difference is high, while allows the leakage of the magnetic flux generated by the primary winding part 15 to be reduced, and causes the generated magnetic flux to make an interlinkage with the secondary winding part 13, thus enabling the high-voltage generating transformer 1 to furthermore improve in characteristics, and enabling the transformer to meet the lighting of an Hg-free bulb because it is arranged that the primary winding bobbin 14 be stepwise changed in thickness every section or every plurality of sections of the secondary winding part 13 such that the primary winding bobbin 14 has a thickened thickness on the high voltage side 14*b* where the potential difference is high between the secondary winding part 13 that is divided between the plurality of sections of the secondary winding bobbin 12 having the core 11 disposed in its central portion and that is wound on the bobbin and the primary winding part 15 wound on the primary winding bobbin 14 disposed around the outer peripheral of the secondary winding part 13, and the primary winding bobbin has a thinned thickness on the low voltage side 14*a* where the potential difference therebetween is low, and the primary winding part 15 be wound on the primary winding bobbin 14 such that the winding thereof covers the entire region of the secondary winding part.

Further, the withstand voltage between the output terminal 16 and the secondary winding part portion 13*a* in the low voltage section can be ensured, while the structure of winding part where the leakage of the magnetic flux between the secondary winding part and the primary winding part 15 is reduced can be provided, thus enabling the high-voltage generating transformer 1 to improve in characteristics because it is arranged that the secondary winding bobbin 12 be stepwise changed in thickness every section or every plurality of sections of the secondary winding part such that the secondary winding bobbin 12 has a thinned thickness on the high voltage side of the secondary winding part 13 and have a thickened thickness on the low voltage side thereof.

Moreover, since the primary winding part 15 is arranged by winding a plurality of wire materials in parallel, the clearance between the wires constituting the primary winding part 15 decreases to enable the magnetic flux passing through therebetween to be reduced, and further, enable the magnetic flux generated by the primary winding part to be more led to the secondary winding part, thus permitting the high-voltage generating transformer to be enhanced in characteristics.

Furthermore, each of the plurality of wire materials constituting the primary winding part wound in parallel uses a fine wire, and the total cross-sectional area of the plurality of fine wires wound in parallel is arranged to be the desired cross-sectional area, which enables current to flow therethrough in an amount equivalent to that of the current flowing through a single wire having the same cross-sectional area, and enables the high-voltage generating transformer 1 to be more enhanced in characteristics. Besides, this enables the outermost diameter of the transformer to be reduced, thus realizing the size reduction of the high-voltage generating transformer 1. This does not increase the size of an igniter, and can realize an igniter capable of meeting the lighting of an Hg-free bulb and having a size almost equivalent to that of an igniter for a conventional bulb.

Further, the creeping distance between the primary winding part 15 of low voltage and the lead-out portion 13C or the tip 16*a* of the output terminal 16 of the secondary winding part 13 outputting the high voltage can be elongated, the withstand voltage between the two portions can be ensured, and destruction caused by discharge can be avoided even in a small space of the small high-voltage generating transformer 1 because a structure is employed where the foldlike protrusion 17*a* of an insulating wall provided in the case 17 is inserted and assembled in the recess 14*c* provided in the terminal portion of the primary winding bobbin 14 such that the inner face of the recess 14*c* is opposed to the outer face of the foldlike protrusion 17*a* thereof.

It should be understood that the high-voltage generating transformer 1 having the above-described structure is enabled to meet a newly commercialized Hg-free bulb, and is enhanced in performance of an igniter; however, the high-voltage generating transformer 1 having such a structure can be applied to a high-voltage generating transformer for a conventional bulb, can enhance the performance of an igniter for a conventional bulb, and can reduce the size of the igniter.

Second Embodiment

The high-voltage generating transformer 1 in accordance with the first embodiment uses a structure where the primary winding bobbin 14 is stepwise changed in thickness.

The transfer may use a primary winding bobbin having a structure where the thickness is changed in a wedgelike shape from one end to another instead of stepwise shape.

Figure 5:
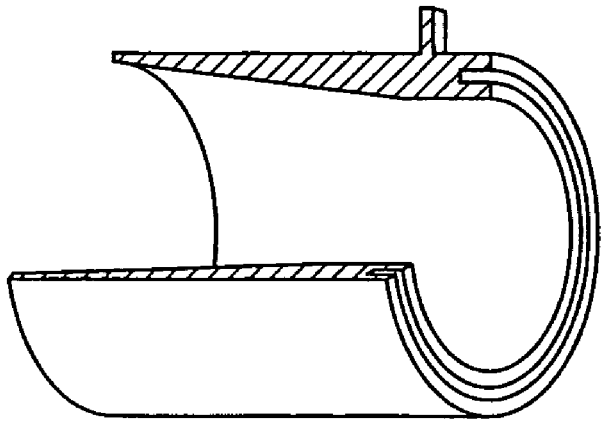
FIG. 5 is a structural explanatory view of an example of a primary winding bobbin used for a high-voltage generating transformer for a discharge lamp lighting apparatus in accordance with the second embodiment of the invention.

An example of the structure of the primary winding bobbin changed in a wedgelike shape is shown in FIG. 5.

FIG. 5 is a structural explanatory view of an example of the primary winding bobbin used in the high-voltage generating transformer for a discharge lamp lighting apparatus in accordance with the second embodiment of the present invention, and is an external oblique view with portions broken away thereof.

As shown in FIG. 5, the primary winding bobbin has a shape where the inner side (the inner periphery) thereof is formed in a wedgelike shape and the outer side (the outer periphery) is constantly (levelly) formed as with that of FIG. 4.

Also in the case where the primary winding bobbin shown in FIG. 5 is used, the thickness thereof reduces on the low voltage side where the potential difference between the primary winding part and the secondary winding part is low, and the withstand voltage is ensured on the high voltage side where the potential difference therebetween is high, which enables the leakage of the magnetic flux generated by the primary winding part to be reduced, and permits the high-voltage generating transformer 1 to further improve in characteristics as with the first embodiment.

As opposed to the structure shown in FIG. 5, the transformer may have a structure where the outer side (the outer periphery) thereof is given the shape of a wedge and the inner side (the inner periphery) thereof is constantly (levelly) formed, instead of the structure where the inner side (the inner periphery) of the primary winding bobbin is given the shape of a wedge. Also in such a structure, the effect can be obtained in improving the characteristic of the high-voltage generating transformer, equivalent to that of the structure where the bobbin has the shape of a wedge on the inner side (the inner periphery).

It should be appreciated that when the primary winding bobbin is arranged to have a uniform thickness in place of forming the inner side (the inner periphery) of the primary winding bobbin in wedge shape as shown in FIG. 5, packing material having insulating property equivalent to that of the primary winding bobbin is packed between the primary winding bobbin having the uniform thickness and the secondary winding part, and the inner side thereof containing the shaped packing material is formed in wedge shape, an effect equivalent to that obtained by using the primary winding bobbin 14 of which the inner side (the inner periphery) is formed in wedge shape can be obtained as with the case of the primary winding bobbin of which the inner side (the inner periphery) is stepwise formed described in the first embodiment.

INDUSTRIAL APPLICABILITY

As mentioned hereinabove, since the high-voltage generating transformer for a discharge lamp lighting apparatus according to the present invention can improve in the characteristics of a high-voltage generating transformer by reducing the leakage of the magnetic flux generated by the primary winding part and causing the generated magnetic flux to make an interlinkage with the secondary winding part, while ensuring the insulation between the primary winding part, the transformer is suitable for use particularly in an on-vehicle headlight or the like meeting an Hg-free bulb supported by an igniter having a size approximately equivalent to that of an igniter for a conventional bulb.

The invention claimed is:

1. A high-voltage generating transformer for a discharge lamp lighting apparatus comprising:

a core made of a rodlike magnetic material;

a secondary winding bobbin that is divided into a plurality of sections, and where the core is disposed in the central portion thereof;

a secondary winding part wound on the secondary winding primary winding bobbin, divided between the plurality of sections of the bobbin;

a primary winding primary winding bobbin disposed around the outer periphery of the secondary winding part; and a primary winding part wound on the primary winding bobbin, wherein the primary winding bobbin is changed in thickness every section or every plurality of sections of the second winding part such that the bobbin has a thickened thickness on the side where the potential difference between the primary winding part and the secondary winding part is high, and that the bobbin has a thinned thickness on the side where the potential difference is low, and wherein the primary winding part is wound thereon by winding a plurality of wires in parallel.

2. The high-voltage generating transformer for a discharge lamp lighting apparatus according to claim 1, wherein the secondary winding bobbin is changed in the thickness of the portion of the secondary winding bobbin opposed to the core every section or every plurality of sections thereof according to the potential difference between the output terminal thereof or the core and the secondary winding part.

3. The high-voltage generating transformer for a discharge lamp lighting apparatus according to claim 1, wherein the primary winding part wound in parallel uses fine wires.

4. The high-voltage generating transformer for a discharge lamp lighting apparatus according to claim 1, wherein the creeping distance between the primary winding part of a low voltage, and the lead-out portion of the secondary winding part outputting a high voltage or the tip of the output terminal thereof is elongated by arranging the transformer to have a complicated shape such that the inside surface of the terminal portion of the primary winding bobbin opposed to the portion of the secondary winding part where the high voltage is generated is opposed to the outside surface of a fold projecting in a crinkle-like form from a case housing the high-voltage generating transformer.

* * * * *